US006293394B1

(12) United States Patent
Marbler et al.

(10) Patent No.: US 6,293,394 B1
(45) Date of Patent: Sep. 25, 2001

(54) POUCH-SHAPED FORM OF PACKAGING

(75) Inventors: Claude A. Marbler, Phalsbourg (FR); Juris Walter, Schaffhausen; Andreas Ziegler, Stetten, both of (CH)

(73) Assignee: Alusuisse Technology & Management, LTD, Neuhausen am Rheinfall (CH)

( * ) Notice: Subject to any disclaimer, the term of this patent is extended or adjusted under 35 U.S.C. 154(b) by 0 days.

(21) Appl. No.: 09/419,932

(22) Filed: Oct. 18, 1999

(30) Foreign Application Priority Data

Oct. 27, 1998 (EP) ..... 98811077
Jul. 2, 1999 (EP) ..... 99810568

(51) Int. Cl.[7] ..... B65D 85/72

(52) U.S. Cl. ..... 206/218; 383/40; 383/906; 220/707; 220/714; 220/715; 426/85; 426/115

(58) Field of Search ..... 426/85, 115, 394, 426/410; 229/103.1; 215/388, 389, 900; 20/705, 707, 708, 709, 710, 714, 715; 53/133.1; 222/490; 383/906, 40; 206/216, 217, 218

(56) References Cited

U.S. PATENT DOCUMENTS

| | | | | |
|---|---|---|---|---|
| D. 362,618 | * | 9/1995 | Paling et al. | D9/305 |
| 3,279,679 | | 10/1966 | Engelsher et al. | 229/103.1 |
| 3,545,604 | | 12/1970 | Gunther | 206/217 |
| 3,799,914 | | 3/1974 | Schmit et al. | 426/85 |
| 4,291,814 | | 9/1981 | Conn | 220/90.4 |
| 4,485,963 | | 12/1984 | Panicci | 229/75 |
| 5,085,349 | * | 2/1992 | Fawcett | 222/175 |
| 5,201,460 | | 4/1993 | Caines | 229/103.1 |
| 5,564,591 | | 10/1996 | Christine et al. | 220/705 |

FOREIGN PATENT DOCUMENTS 653199 5/1951 (GB) .

* cited by examiner

*Primary Examiner*—Milton I. Cano
*Assistant Examiner*—Robert Madsen
(74) *Attorney, Agent, or Firm*—Fisher, Christen & Sabol

(57) ABSTRACT

A packaging pouch (10) with an integral drinking straw or pouring spout (38,42) and an easy-to-open protective region providing access to the drinking straw or pouring spout, features a first compartment (32) to accommodate the contents e.g. a drink and—separated in a fluid-tight manner—a second compartment (34) to accommodate a tube part (42). The tube (38, 42) leads from the first compartment (32) to the second compartment (34) and is joined in the transition region to the pouch (10) in a fluid-tight manner and features a valve element for opening and closing a through-flow channel (37). At the end projecting into the second compartment the tube features a closure (44,46) which is closed in a fluid-tight manner when the pouch is in the unopened state and contains a valve element (58, 56) which, under the action of pressure from the side, frees a through-flow channel (37) and which closes automatically.

19 Claims, 3 Drawing Sheets

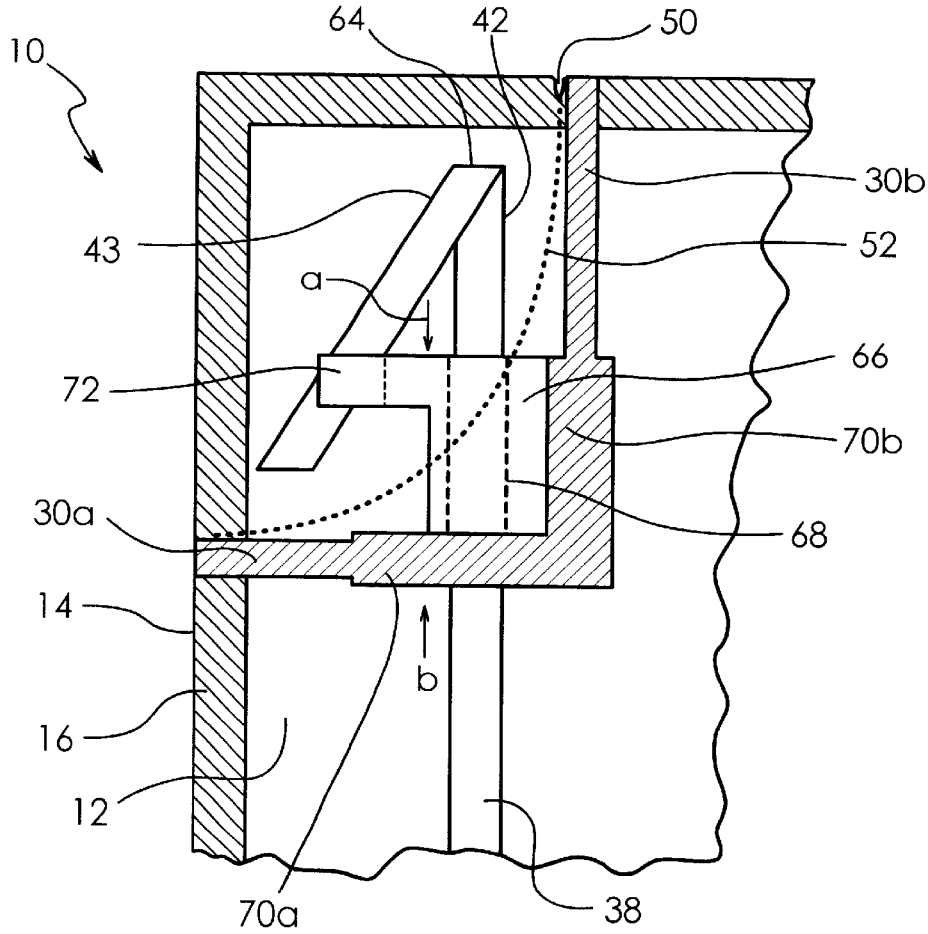
FIG. 7
FIG. 8
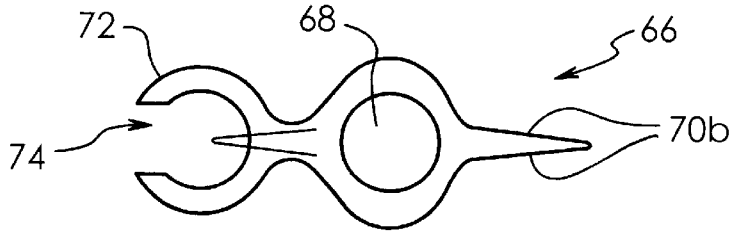
FIG. 9
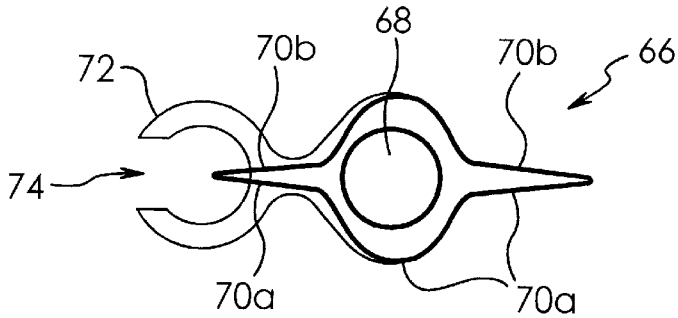

POUCH-SHAPED FORM OF PACKAGING

FIELD OF THE INVENTION

The invention relates to a pouch-shaped form of packaging featuring a drinking straw or pouring spout and an easy-open protected region providing access to the straw.

BACKGROUND OF THE INVENTION

Many packaging pouches for drinks feature a drinking straw attached to the outside of the pouch. The drinking straw which is attached at an angle to one side of the package is pushed through the wall of the pouch at a prescribed place. If the drinking straw is handled incorrectly e.g. by children, it can bend without penetrating the pouch. Another problem is the danger of the sloping straw causing injury, and the possibility of the contents running out due to incorrect handling.

Another flexible pouch is known in which the drinking straw is provided in the interior of the pouch i.e. in the same space as the contents. The self-standing pouch features in the region of the upper edge a notch joining up to a tear line for tearing the pouch open. The length of the drinking straw is chosen such that its lower end is situated at the lowest part of the pouch and its upper end lies above the tear line. With this arrangement the drinking straw is completely accessible after tearing the pouch open. It has however been found disadvantageous that if the pouch is torn open without due care, or if the aid to tearing does not readily function, then on opening the pouch some of its contents can run out in an uncontrolled manner.

In another known pouch for drinks featuring an integral drinking straw, the latter is contained in a kind of pocket which is separated from the actual pouch by means of a film. The straw is flexible in design in the drinking part and is hygienically packed by means of a peel-back film. After tearing off this protective film, the drinking straw is straightened out and—under the action of a small amount of pressure—the lower end pushed out of the inner pocket and into the space in the pouch filled with drinking fluid. Also this form of packaging does not provide any preventive measure against the contents running out after the straw has been pushed into the pouch.

All of the pouches for drinks available on the market at present suffer the disadvantage that, after they have been opened there is no easily manageable possibility for closing them again. This can—as mentioned above—lead to staining as a result of the contents running out of the pouch in an uncontrolled manner.

SUMMARY OF THE INVENTION

The object of the present invention is therefore to design a user-friendly packaging pouch. The pouch should in particular feature an integral drinking straw and at the same time should prevent the contents from running out. A further objective of the invention is the provision of a packaging pouch for liquid or paste-like contents with re-sealable drinking straw or pouring spout.

These objectives are achieved by way of the invention in that the pouch comprises a first compartment for the contents and, to accommodate a tube, a second compartment which is separated in a fluid-tight manner from the first compartment where the tube, joined to the pouch in a fluid-tight manner in the transition region, leads from the first compartment to the second compartment, and features a valve element for opening and closing a through-flow channel.

A first version is such that the tube features a valve element which opens up a through-flow channel under the action of pressure applied sideways and closes automatically.

A second version is such that the tube features a moveable joint which—by folding or rotating the tube part projecting into the second compartment—opens and closes the tube.

A preferred variety of the first and second versions of the pouch according to the invention is such that the first compartment is separated from the second compartment by a sealing or adhesively bonded seam, and a connecting piece connecting both compartments is sealed or adhesively bonded to the pouch in a fluid-tight manner over the sealing or adhesively bonded seam. This results in the connecting piece being joined to a first tube part projecting into the first compartment and to a second tube part projecting into the second compartment.

A third version of packaging pouch according to the invention is such that the part of the tube projecting into the second compartment features a fold which in the unopened pouch is fluid-tight and prevents flow through the tube and—after opening the pouch—by straightening out the end piece of the part of the tube projecting into the second compartment permits flow of fluid through the tube.

Preferred is—in the transition region between the first and second compartment—a transition piece with a channel for fluid-tight passage of the tube whereby, in order to increase the security against fluid running out, the transition piece may additionally feature a holder part to accommodate and secure the end piece of the tube in the folded position.

A useful arrangement is such that the transition piece features at least one sealing area that at least partially delimits the second compartment. Particularly suitable is an arrangement whereby the transition piece exhibits two sealing areas that meet perpendicular to each other.

As an additional means of preventing fluid running out, the end of the part of the tube projecting into the second compartment may be provided with an easy-to-open closure which is closed in a fluid-tight manner when the pouch is in the unopened state.

Usefully, the part of the tube projecting into the first compartment, or the first part of the tube, terminates at the lowest point of the first compartment of the pouch when in use—this in order to ensure complete emptying of the pouch.

The part of the tube projecting into the first compartment, or the first part of the tube, is preferably elastically sprung, while the part of the tube projecting into the second compartment or the second part of the tube is preferably deformable and/or extendable and e.g. features an extendable, concertina-like part.

A tear line or peel-back opening is preferably provided in the region of the second compartment in order to provide access to the drinking-straw tube.

The packaging pouch according to the invention may be employed for drinks, for paste-type products such as yoghurts or fruit juices and the like. Another field of application is that of technical products e.g. motor oils, lubricants or washing agents.

The second compartment to accommodate a tube part, which is separate from the first compartment containing the fluid contents, protects the tube from contamination prior to opening, is hygienically packed and can as desired be kept aseptically clean. This is important especially when using the pouch for the packaging of foodstuffs.

Further advantages, features and details of the invention are revealed in the following description of a preferred exemplified embodiment and with the aid of the drawing which shows schematically in:

BRIEF DESCRIPTION OF THE DRAWINGS

FIG. 7 plan view of a part of a third pouch with integral drinking straw and a transition piece;

FIG. 8 an end view of the transition piece in FIG. 7 viewed in direction a;

FIG. 9 a further end view of the transition piece in FIG. 7 viewed in direction b.

DESCRIPTION OF THE PREFERRED EMBODIMENTS

Figure 1:
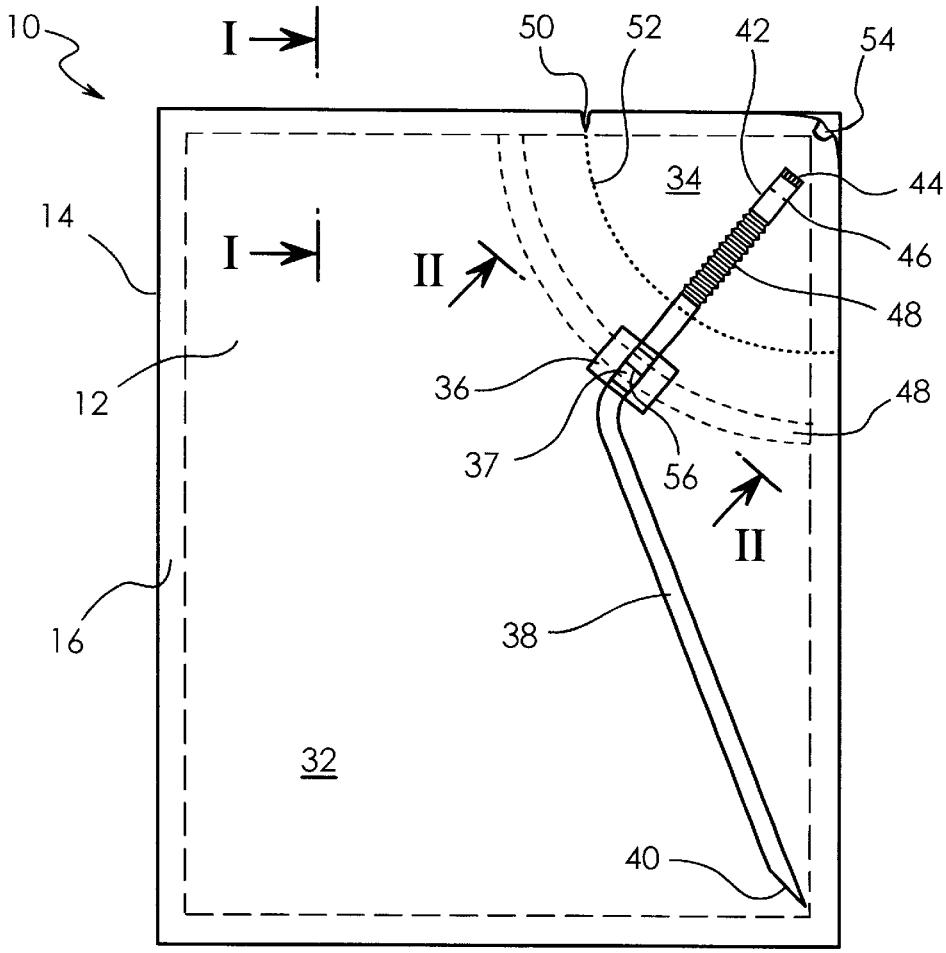
FIG. 1 a plan view of a first pouch with integral drinking straw.

A pouch 10 for drinks shown in FIG. 1 comprises a front wall film 12 and a rear wall film 14 which are joined together via a fluid-tight peripheral seam 16. In the form of a self-standing pouch a base film, which is not shown in the drawing, is provided, welded in a conventional manner between the front wall 12 and the rear wall 14 in the lower region of the part of the pouch later forming the base.

Figure 2:
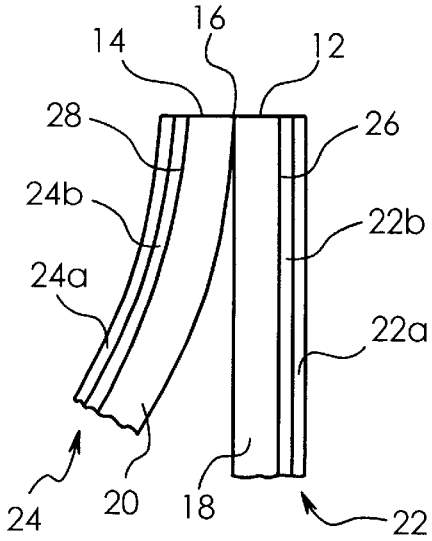
FIG. 2 a cross-section through the pouch in FIG. 1 along line I—I.

As shown in FIG. 2 the front wall 12 comprises e.g. an inner film 18 of polyethylene, polypropylene, their copolymers or ionomers and an outer film 22. The outer film 22 is e.g. a laminate with an outer film 22*a* e.g. of oriented polypropylene (oPP) and an inner film 22*b* e.g. of oriented polyamide or aluminium foil. Alternatively, the inner film 22 may be metallised or feature an oxide layer such as $SiO_x$. A permanent adhesive 26 e.g. based on polyurethane is provided between the inner film 18 and the outer film 22.

In the example shown the rear wall 14 has an identical make-up viz., an inner film 20 e.g. of polyethylene, polypropylene, their copolymers or ionomers which are adhesively bonded to the outer film 24 via a permanent adhesive e.g. of polyurethane. Instead of a permanent adhesive, the inner film 20 may be laminate bonded to the outer film 24 by means of extrusion. The outer film 24 is also comprised here of an outer film 24*a* e.g. of oriented polyethyleneterephthalate (PET) or oriented polypropylene (oPP) and an inner film 24*b* e.g. of oriented polyamide or aluminium foil. The rear wall 14 may however also have another make-up than that of the front wall 12.

The pouch 10 is divided by a further seam 30 into a first compartment 32 for the drink itself and a second compartment 34 for the end of the drinking straw/tube. A connecting piece 36 made e.g. of an elastomer is sealed into the seam 30. The compartments 32, 34 which are sealed in a fluid-tight manner from each other are joined by the connecting piece 36 via a through-flow channel 37.

A first tube-shaped part 38 of the drinking straw is attached to the connecting piece 36 in the first compartment 32; the free end of that part 38 is tapered and terminates at the lowest part of the pouch 10. This first tube-shaped part 38 is preferably elastically sprung so that it remains at the lowest point of the pouch thus ensuring complete emptying of the pouch. A second tube-shaped part 42 of the drinking straw is joined to the connecting piece 36 inside the second compartment 34. The free end 44 of the second part 42 is closed and provided with a line of fracture 46 for first opening. Between the connecting piece 36 and the line of fracture 46 the second part 42 of the drinking straw features a concertina-shaped part 48 which enables the drinking straw to be extended in length and to be bent into the most favourable position for drinking.

Figure 3:
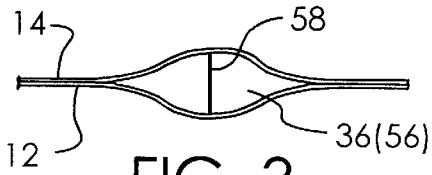
FIG. 3 a cross-section through the closure piece of the pouch in FIG. 1 along line II—II.
Figure 4:
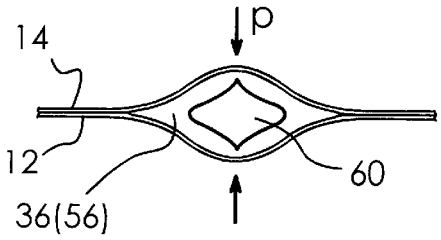
FIG. 4 cross-section of the closure piece in FIG. 3 in the open position.

The connecting piece shown in FIGS. 3 and 4 features a closure part 56 situated in the through-flow channel 37. This closure part 56 features a line or area of separation 58 which, under the action of slight pressure p e.g. applied by means of two fingers, opens up to form a through-flow opening 60. Of course, instead of the closure part 56 shown here other valve systems are conceivable e.g. a nonreturn valve or needle valve.

Figure 5:
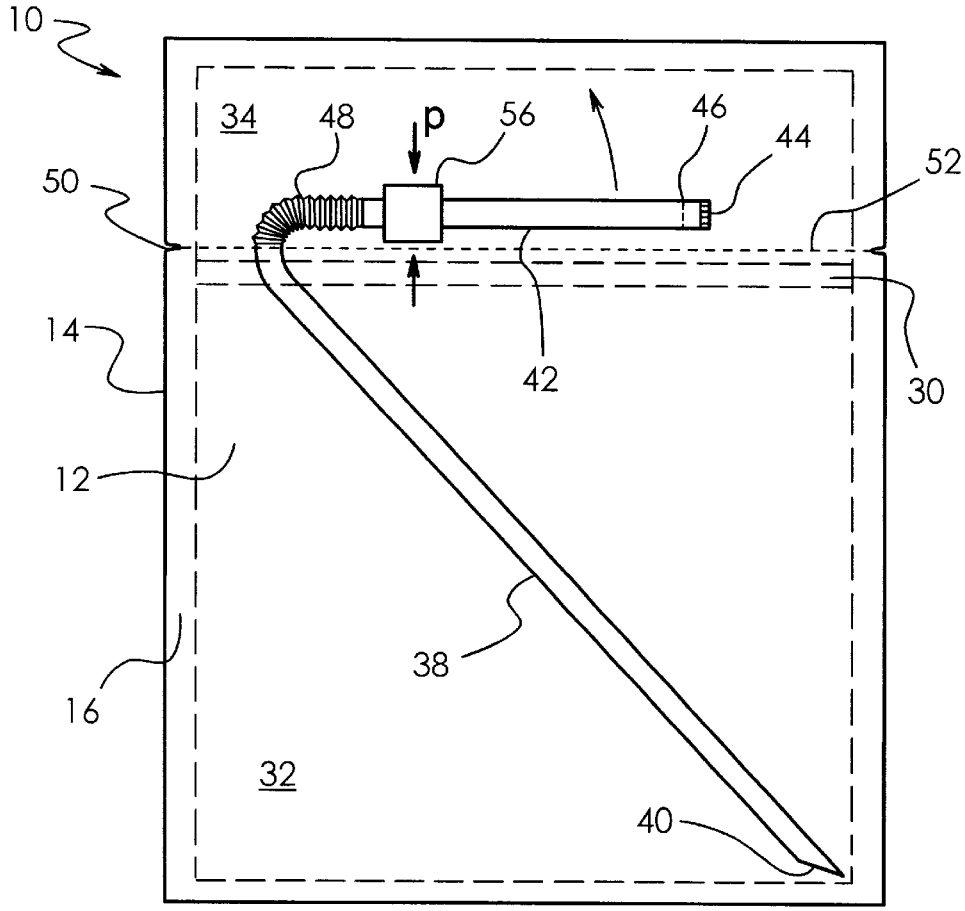
FIG. 5 plan view of a second pouch with integral drinking straw.

In the pouch shown in FIG. 5 the tear line 52 runs parallel to the upper edge of the pouch—this in contrast to the version shown in FIG. 1. The drinking straw 38, 42 is in one single piece and is enclosed directly by the seam 30. Instead of the connecting piece 36 in FIG. 1 with integral closure part 56, the closure part 56 here is folded over the second tube part 42 in the second compartment 34. By way of analogy to that shown in FIGS. 3 and 4, in the absence of force, the second tube part 42 is squeezed against the closure part 56 and is therefore closed off. By applying slight pressure, for example between two fingers, the closure part 56 opens up to form the opening 60 shown in FIG. 4, as a result of which the drinking straw opens up from its compressed state to form a through-flow opening.

Figure 6:
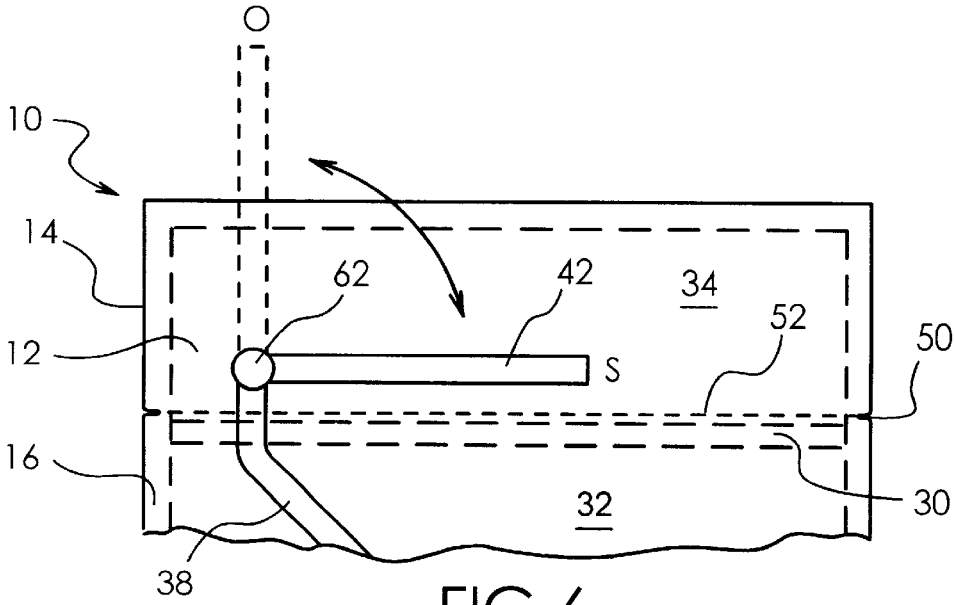
FIG. 6 plan view of a joint closure.

The version of closure system shown in FIG. 6 for the second part 42 of the drinking straw features a joint 62 which can be moved from an open position O to a closed position S and back again. The joint 62 may be a folding type joint which, temporarily, mechanically closes the second part 42 of the drinking straw. An alternative version is such that the joint 62 is e.g. in the form of a two-way valve.

In the pouch shown in FIG. 7 an end piece 43 of the two part drinking straw 42 is provided with a folding point 64 which effectively prevents the flow of fluid through the straw when the straw part 42 is folded over. The point of folding 64 may be achieved by means of an asymmetric division of the plastic of part 42 as viewed in cross-section and by means of a specific heat treatment. After opening the pouch 10, the end piece 43 of the second part 42 of the drinking straw which projects into the second compartment 34 is straightened out—as a result of which the fold 64 allows fluid to flow through the drinking straw.

The second part 42 of the drinking straw passes through a transition piece 66 in which it passes through a channel 68 in a fluid-tight manner and is e.g. adhesively bonded or sealed to the transition piece 66.

The transition piece 66 exhibits two sealed areas 70*a, b* which are perpendicular to each other and are sealed into the pouch 10, to front wall film 12 and rear wall film 14, via seams 30*a, b*. The sealed areas 70*a, b* thereby form a part of the boundary of the second compartment. Alternatively, the transition piece 66 may also feature only one sealing area 70*a*.

The transition piece 66—made by injection moulding of plastic e.g. polyethylene, polypropylene or other injection mouldable plastics—is provided with a holder part 72 which is C-shaped in cross-section and features an opening 74 into which the end piece 43 can be inserted from the side when folded.

The pouch 10 shown schematically in the drawing may of course be of any desired shape e.g. as a self-standing pouch.

What is claimed is:

1. A packaging pouch (10), having two opposing walls, with a tube (38, 42) for drinking or pouring and an easy-to-open protective region as access to the tube (38, 42), which is located inside of the packaging pouch (10), comprises a first compartment (32) that contains fluid contents and, a second compartment (34) in which a first tube part (38) is located, that is separated in a fluid-tight manner from the first compartment (32) by means of transition region (30) formed by joined portions of inside surfaces of the two opposing walls of the pouch, where the tube (38, 42) is joined in the transition region (30) to inside surfaces of the two opposing walls of the packaging pouch (10) in a fluid-tight manner, leads from the first compartment to the second compartment and comprises a valve element for opening and closing a through-flow channel (37), the valve element (58, 56) is positioned in the portion of the tube (38, 42) which is located in the transition region (30) and, under the action of pressure from the side, frees the through-flow channel (37) and closes automatically.

2. The packaging pouch according to claim 1, wherein the extending item (66) comprises at least one sealing surface **(70*a*) which at least partially delimits the second compartment (34)**.

3. The packaging pouch according to claim 2, wherein the extending item (66) comprises two sealing surfaces **(70*a, b*)** that meet perpendicular to each other.

4. The packaging pouch according to claim 3, wherein the end of tube (38, 42) projecting into the second compartment (34) is provided with the tube part (42) which is fluid-tight when the pouch is in the unopened state.

5. The packaging pouch according to claim 4, wherein, in order to ensure complete emptying of the pouch (10), the tube (38) terminates at that point of the first compartment (32) of the pouch (10) which is lowest during use.

6. The packaging pouch according to claim 1, wherein part of the tube part (38) projecting into the first compartment (32) is elastically sprung.

7. The packaging pouch according to claim 6, wherein part of the tube part (42) projecting into the second compartment (34) is deformable and/or can be drawn out.

8. The packaging pouch according to claim 7, wherein the part of the tube projecting into the second compartment (34) comprises a part (48) which can be drawn out in a concertina-like manner.

9. The packaging pouch according to claim 8, wherein a tear line (52) or peel-open opening is provided in a region of the second compartment (34) to provide access to the tube part (42).

10. The packaging pouch according to claim 1, wherein the end of tube (38, 42) projecting into the second compartment (34) is provided with an easy-to-open closure (56) which is fluid-tight when the pouch is in the unopened state.

11. The packaging pouch according to claim 1, wherein the first compartment (32) is separated from the second compartment (34) by a sealed or adhesively bonded seam (30),and a connecting piece (36) which connects both compartments (32, 34) is sealed or adhesively bonded to the pouch in a fluid-tight manner over the sealed or adhesively bonded seam (30), whereby the connecting piece (36) is joined to a first tube part (38) projecting into the first compartment (32) and to a second tube part (42) projecting into the second compartment (34).

12. The packaging pouch according to claim 11, wherein the end of tube (38, 42) projecting into the second compartment (34) is provided with an easy-to-open closure (56) which is fluid-tight when the pouch is in the unopened state.

13. The packaging pouch according to claim 12, wherein, in order to ensure complete emptying of the pouch (10), the portion of the tube part (42) projecting into the first compartment (32) or the first part of the tube terminates at that point of the pouch (10) which is lowest during use.

14. The packaging pouch according to claim 13, wherein a part of the tube projecting into the first compartment (32) or a first part of the tube (38) is elastically sprung.

15. The packaging pouch according to claim 14, wherein the part of the tube projecting into the second compartment (34) or the second part of the tube (42) is deformable and/or can be drawn out.

16. The packaging pouch according to claim 15, wherein the part of the tube projecting into the second compartment (34) or the second part of the tube (42) features a part (48) which can be drawn out in a concertina-like manner.

17. The packaging pouch according to claim 16, wherein a tear line (52) or a peel-open opening is provided in the region of the second compartment (34) to provide access to the tube (42).

18. The packaging pouch according to claim 1, wherein the end of tube (38, 42) projecting into the second compartment (34) is provided with an easy-to-open closure (56) which is fluid-tight when the pouch is in the unopened state.

19. A packaging pouch (10), comprises two opposing walls, with a tube (38, 42) for drinking or pouring, a seal portion of the pouch (10) which separates the pouch (10) in a fluid-tight manner into a first compartment (32) and a second compartment (34), an extending item (66) that is located in a fluid-tight manner in the seal portion and extends into the second compartment (34), a locking piece (72) is located on the extending item (66) that extends into the second compartment (34), the first compartment (32) contains fluid contents of pouch (10) and a tube part (38), the tube (38, 42) extends in a fluid-tight manner through a passageway (68) in extending item (66), the second compartment (34), pouches provide an easy-to-open protective region for access to a tube part (42) that is located in an projects into the second compartment (34), the tube part (42) of the tube (38, 42) has a fold (64) that effectively prevents the flow of fluid through the tube (38, 42) when pouch (10) is in the unopened state and, after opening the pouch (10), permits flow through the tube (38, 42) by straightening out end piece of the tube part (42), the locking piece (72) secures the end piece (43) of the tube portion (42) in the folded position.

* * * * *